United States Patent [19]

Schwarz et al.

[11] Patent Number: 5,076,050

[45] Date of Patent: Dec. 31, 1991

[54] THERMAL CLEARANCE CONTROL METHOD FOR GAS TURBINE ENGINE

[75] Inventors: Fred M. Schwarz; Clifton J. Crawley, Jr., both of Glastonbury, Conn.

[73] Assignee: United Technologies Corporation, Hartford, Conn.

[21] Appl. No.: 370,426

[22] Filed: Jun. 23, 1989

[51] Int. Cl.[5] ..... F02K 3/04

[52] U.S. Cl. ..... 60/39.02; 60/39.75; 415/117

[58] Field of Search ..... 60/39.02, 39.29, 39.75; 415/115, 116, 117, 178

[56] References Cited

U.S. PATENT DOCUMENTS

| | | | |
|---|---|---|---|
| 4,019,320 | 4/1977 | Redinger, Jr. et al. . | |
| 4,257,222 | 3/1981 | Schwarz | 60/39.02 |
| 4,304,093 | 12/1981 | Schulze | 60/39.75 |
| 4,329,114 | 5/1982 | Johnston et al. . | |
| 4,487,016 | 12/1984 | Schwarz et al. . | |
| 4,513,567 | 4/1985 | Deveau et al. | 60/39.02 |
| 4,773,212 | 9/1988 | Griffin et al. | 60/39.02 |
| 4,849,895 | 7/1989 | Kervistin | 60/39.75 |
| 4,893,983 | 1/1990 | McGreehan | 60/39.29 |

*Primary Examiner*—Louis J. Casaregola
*Assistant Examiner*—John A. Savio, III
*Attorney, Agent, or Firm*—Troxell K. Snyder

[57] ABSTRACT

A method for enhancing the thermal response of the engine case and annular shroud during the transient response period following a step change in engine power provides for the temporary reduction or elimination of the flow of cooling air supplied to the engine case by the active clearance control system. An alternate method additionally substitutes a flow of relatively warm air to further increase the response of the case.

2 Claims, 2 Drawing Sheets

THERMAL CLEARANCE CONTROL METHOD FOR GAS TURBINE ENGINE

CROSS REFERENCE TO RELATED APPLICATIONS

Reference is hereby made to copending commonly-assigned U. S. Patent Applications titled "Clearance Control Method for Gas Turbine Engine" by F. M. Schwarz, K. R. Lagueux, C. J. Crawley, Jr., and A. J. Rauseo, filed on even date herewith and which disclose related subject matter.

Field of Invention

The present invention relates to a method for controlling blade tip to shroud clearance in a gas turbine engine or the like.

Background

The control of the radial clearance between the tips of rotating blades and the surrounding annular shroud in axial flow gas turbine engines is one known technique for proving engine efficiency. By reducing the blade tip to shroud clearance, designers can reduce the quantity of turbine working fluid which bypasses the blades, thereby increasing engine power output for a given fuel or other engine input.

"Active clearance control" refers to those clearance control arrangements wherein a quantity of cooling air is employed by the clearance control system to regulate the temperature of certain engine structures and thereby control the blade tip to shroud clearance as a result of the thermal expansion or contraction of the cooled structure. It is a feature of such active clearance control systems that the cooling air flow may be switched or modulated responsive to various engine, aircraft, or environmental parameters for causing a reduction in blade tip to shroud clearance during those portions of the engine operating power range wherein such clearance control is most advantageous.

A reduction of blade tip to shroud clearance must be achieved judiciously. For example, overcooling the turbine case supporting the annular shroud such that the shroud interferes with the rotating blade tips results in premature wear of the shroud or abrasion and damage to the blade tips. It is therefore important that the reduction in blade tip to shroud clearance achieved by such clearance controls systems must be designed so as to avoid the occurrence of blade tip and shroud interference which may ultimately cause deterioration of overall engine operating efficiency, or worse, damage to the engine internal components.

DISCLOSURE OF THE INVENTION

It is therefore an object of the present invention to provide a method for controlling radial clearance between the tips of a plurality of rotating blades and a surrounding annular shroud disposed within a gas turbine engine or the like.

The present invention provides a method for minimizing blade tip to shroud clearance during steady state, part power engine operation by reducing the transient thermal response mismatch between the slow responding stationary annular shroud supported by the external engine case and the fast responding rotating blades. This mismatch occurs in the time period immediately following a step change in engine power which is accompanied by increases in the pressure, temperature, and rotor speed in the turbine section of the engine. The present invention is based in part on the recognition that, following a step increase in engine power, the blade tips in the turbine section initially move radially outward as a result of increased angular speed and temperature at a rate more quickly than a surrounding case supported shroud ring.

The present invention provides for increasing the case temperature during the transient period following a step power change, either by temporarily reducing or eliminating any external case cooling air flow for those engine configurations having such external cooling for clearance control, or by providing a flow of relatively hot external air to the case for increasing the temperature, or both. The engine case, warmed by the reduction in cooling and/or the heated air, expands thermally and radially more quickly than prior art engines having continuous cooling air flow, thereby reducing the transient mismatch between the blade tips and shroud.

Benefits of the method according to the present invention include the avoidance of radial interference between the blade tips and shroud following an engine power change as well as a reduction in the additional clearance which must be provided at certain engine power levels in anticipation of a potential step increase in engine power. This latter advantage is most evident for engines having modulated cooling air flow scheduled against engine power level so as to optimize blade tip to shroud clearance during steady state engine operation within an operating range. Both these and other objects and advantages of the clearance control system according to the present invention will be obvious to those skilled in the art upon review of the following detailed description and the appended claims and drawing figures.

DETAILED DESCRIPTION OF THE INVENTION

The use of cooling air to control radial clearance between a plurality of rotating blade tips and a surrounding annular shroud in a gas turbine engine is well known. Such cooling air flow is typically exhausted on the exterior engine case which supports the surrounding annular shroud for the purpose of shrinking the case and shroud thermally, thereby reducing the operating clearance at least during cruising operation of the engine. It is also disclosed in the co-pending, application entitled "Clearance Control Method for Gas Turbine Engine", Application Ser. No. 07/372,398 referenced above, to schedule the flow of cooling air responsive to the current engine power level so as to achieve an excess radial clearance during operation below the maximum power level within the engine's normal power range. This excess radial clearance is sized to accommodate the expected transient radial thermal mismatch in growth rate between the blade tips and surrounding shroud following a step change in engine power.

Figure 1A:
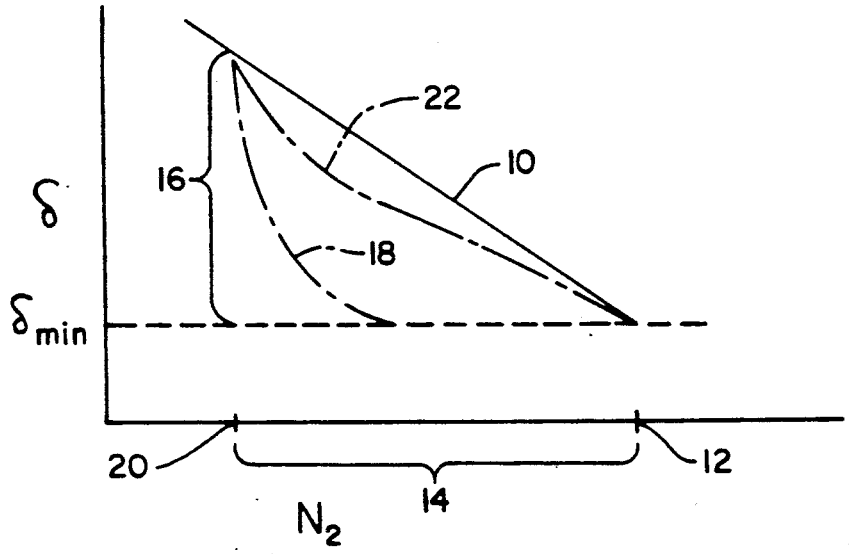
FIG. 1*a* represents the radial clearance versus current engine power for steady state and transient conditions.

The method according to the present invention improves upon the method disclosed in the above-referenced patent application by enhancing the thermal response of the engine case to a step change in engine power as will be described below. FIG. 1*a* shows a schematic plot of radial clearance δversus current engine power level as represented by high rotor speed $N_2$. The steady state variation in clearance 10 appears as the solid curve which indicates the achievement of the minimum radial clearance $\delta_{min}$ at steady state operation of the engine at the maximum power level 12 within the normal engine power range 14. As is noted in the co-pending application, the curve 10 is achieved by properly scheduling the flow of cooling air to the engine case with respect to engine power, or the equivalent parameter high rotor speed $N_2$, so as to leave an excess radial clearance 16 in addition to the minimum required clearance $\delta_{min}$ during steady state operation of the engine at power levels less than the maximum normal power level 12.

The excess clearance 16 is sized to accommodate the transient thermal growth mismatch between the blade tips and shroud which results in the broken curve 18 representing the envelope of the transient response of blade tip to shroud clearance following a step change in engine power from, for example, the minimum normal power 20 to the maximum power level 12. The clearance δ, as represented by transient envelope curve 18, decreases in the period following the step change eventually reaching $\delta_{min}$ as rotor speed increases from 20 to 12. The cause of this mismatch is the different thermal response rate of the engine case and blades, wherein the blades respond quickly to the increased temperature, pressure and rotor speed moving radially outward at a rate quicker than the surrounding case and shroud. As the pressure, temperature and exterior cooling of the case increase, the case eventually reaches steady state operating temperature at the new, maximum power level 12 thereby reestablishing the blade tip to shroud clearance at the steady state level represented by the curve 10.

The present invention increases the thermal response of the case and shroud by reducing or eliminating the flow of cooling air responsive, for example, to a step change in engine power from a reduced power level to a higher power level within the normal range 14. This reduction is responsive to the position of the engine power lever (not shown) thereby anticipating the final engine power level required by the engine operator and actively modifying the flow of cooling air to the exterior engine case accordingly. The effect of such modification may be seen in FIG. 1*a* as the higher broken curve 22 which represents a greatly reduced thermal growth mismatch and hence smaller transient deviation of the blade tip to shroud clearance.

Figure 1B:
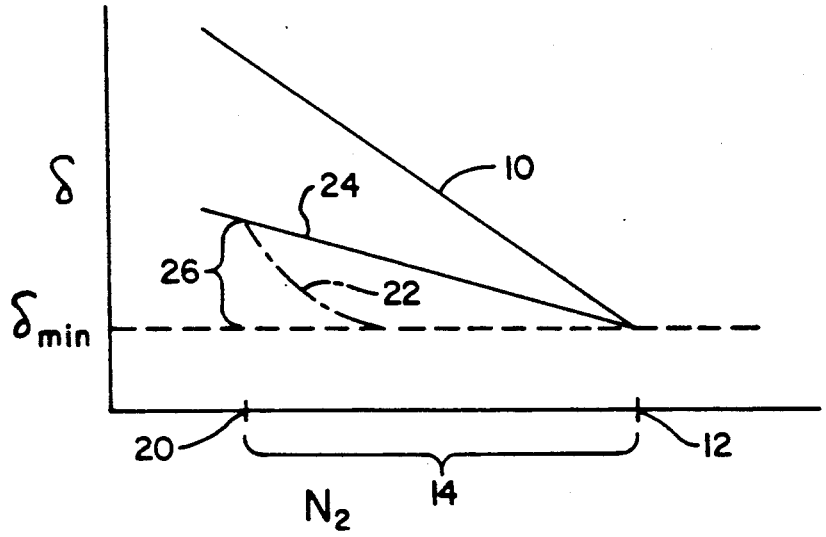
FIG. 1*b* shows the envelope of the transient variation in clearance resulting from an increased engine case thermal response.

The advantage of increasing case thermal response may be viewed in FIG. 1*b* in which a new steady state curve 24 has been provided to reflect the reduced thermal mismatch envelope as shown by the transient broken curve 22. The steady state curve 24 thus accommodates the reduced transient thermal growth mismatch between the blade tips and shroud in the active clearance control method according to the present invention, providing a further advantage by reducing the excess radial clearance 26 required during operation of the engine at lower power levels within the normal operating range 14.

As noted above, enhanced case thermal response may be achieved by reducing the flow of cooling air to the engine case, eliminating it at least during the transient response period following a step change in engine power, or, in still another variation of the method according to the present invention, substituting a relatively warm flow of air from the engine compressor or any other source within the aircraft for temporarily increasing case temperature following such a step increase. It should be noted that such reduction, elimination or substitution of heated air is only provided by the method according to the present invention during the transient response period following such a step change in engine power. Normal clearance control operation is reestablished after a predetermined time period so as to return the clearance control system to a steady state, efficient operating condition.

Figure 2:
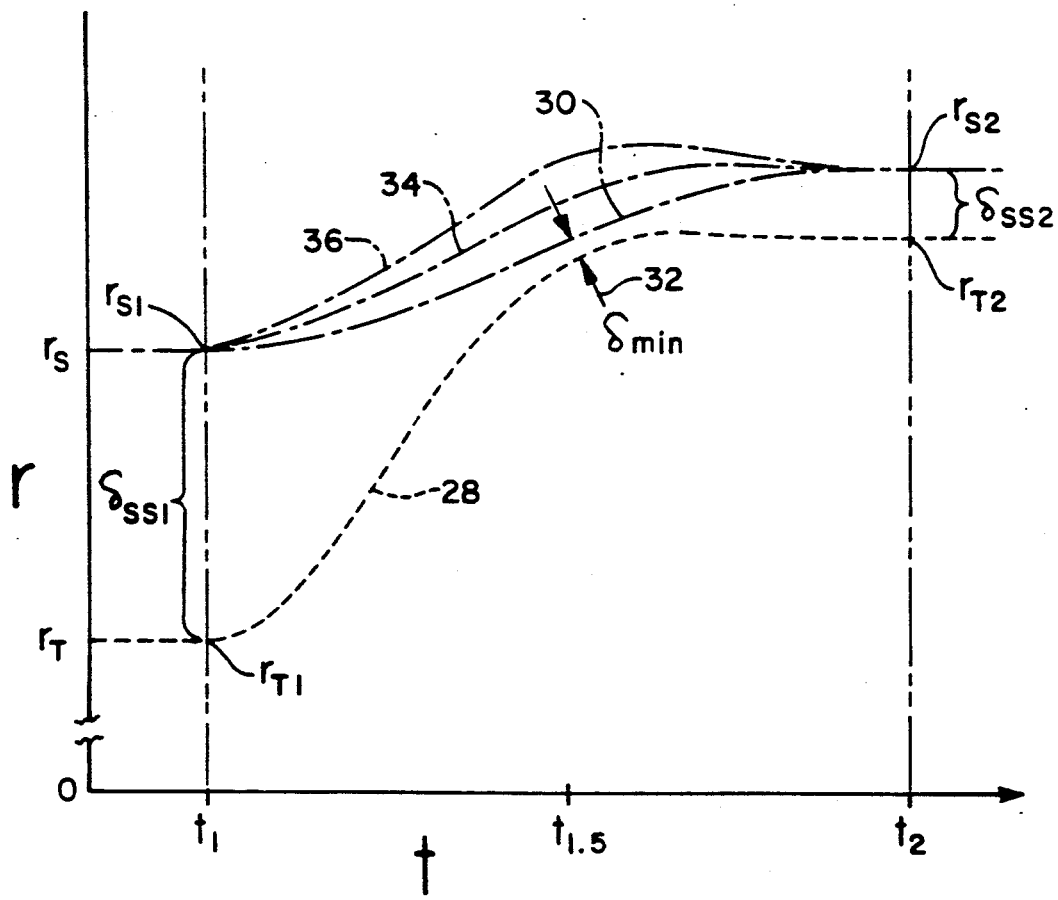
FIG. 2 shows the radial displacement of the surrounding shroud and blade tips during a step increase in engine power for both the method according the present invention and the prior art.

FIG. 2 shows a schematic representation of the response of the inner radius of the annular shroud and the outer radius of the rotating blade tips versus time following a step change in engine power from a first power level to a second, higher power level. In FIG. 2, the vertical axis represents the radius of the blade tips, $r_T$ and the shroud $r_S$. Up until time $t_1$, $r_{S1}$ and $r_T$ are separated by a steady state clearance $\delta_{SS1}$. At time, $t_{1.5}$ a step change in engine power level is initiated resulting in rapid radial growth of the blade tips as is shown by curve 28. The shroud as represented by $r_{S2}$ also increases according to curve 30 but at a reduced rate for clearance control method according to the co-pending patent application cited above. At approximate time $t_1$, the minimum clearance $\delta_{min}$ is reached as shown by the gap 32 between curves 28 and 30. Time $t_2$ represents the end of the transient engine thermal response with the shroud and blade tips for having a steady state radial clearance of $\delta_{SS2}$.

According to the present invention, reduction or elimination of the exterior case cooling at the time an increase in demanded engine power is determined alters the thermal response and hence radial growth of the case as represented by $r_{S2}$ in FIG. 2. Curves 34 and 36 schematically represent the enhanced thermal response of the engine case and supported shroud by the method according to the present invention. Curve 34 shows the response of the shroud to a temporary elimination of cooling air flow, while curve 36 represents the additional radial growth achieved by substituting a flow of heated air which even further enhances the radial growth during the critical transient period between $t_1$ and $t_2$. The increase of the pinch point or minimum radial clearance $\delta_{min}$ 32 resulting from the active clearance control method according to the present invention allows for a reduction in the steady state clearance between the blade tips and shroud $\delta_{SS1}$, thereby improving overall engine efficiency during part or reduced power operation.

Figure 1C:
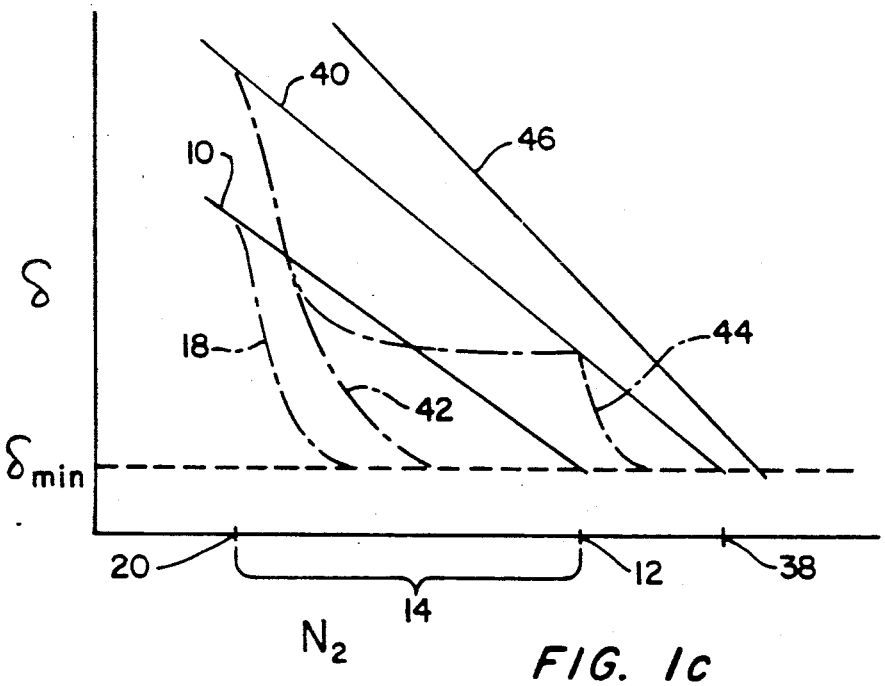
FIG. 1*c* shows the variation of clearance for an engine with the flow of clearance controlling cooling air shut off.

The method according to the present invention may be further extended so as to be selectable by the aircraft operator during periods of exceptional aircraft operation such as, for example, during the use of the aircraft for pilot training. Such pilot training may include simulated operation under emergency conditions wherein the engine may be called upon to operate outside of the normal power range 14. FIG. 1*c* compares such exceptional operation wherein the engine may be required to achieve a maximum power level 38 above the normal maximum power level 12 and outside of the normal range 14. During such training sessions, the flow of cooling air to the engine may be rescheduled so as to achieve a steady state clearance as represented by curve 40 which is above the normal curve 10 whereby step increases in power from, for example the minimum power level 20 to maximum power as represented by broken transient curve 42 or from the maximum normal power 12 to maximum emergency power 38 as is represented by broken curve 44.

As such pilot exercises are conducted infrequently, the short term cost of operating efficiency resulting from the reduction or elimination of the exterior case cooling air weighs less heavily than the need to avoid damage or radial interference between the blade tips and shroud as the engine is called upon to produce power at levels outside of the normally expected range 14.

The present invention is thus well suited to respond to step changes in engine power as well anticipated unusual engine operating conditions by reducing or eliminating a flow of cooling air at least temporarily. It is still a further feature of the active clearance control method according to the present invention to substitute a flow of heated air to the engine case during such transient periods for the purpose of further enhancing case thermal response.

We claim:

1. Method for controlling blade tip to shroud clearance at a plurality of steady state, part load operating conditions in a gas turbine engine having an output power level responsive to the position of an engine power lever and further having an active clearance control system delivering a scheduled flow of cooling air to an engine case supporting the shroud radially with respect to the rotating blade tips, comprising the steps of:

determining the occurrence of a change in position of the engine power lever;

reducing the flow of cooling air to the engine case responsive to the determined occurrence of the lever position change;

restoring the scheduled flow of cooling air to the engine case after a predetermined elapse of time.

2. A method as described in claim 1, further comprising the step of:

delivering a flow of heated air to the engine case responsive to the determined occurrence of a change in position of the engine power lever.

* * * * *